United States Patent [19]

Barrett

[11] Patent Number: 4,790,291

[45] Date of Patent: Dec. 13, 1988

[54] SEDIMENT AGITATING APPARATUS FOR WATER HEATER

[75] Inventor: Fred E. Barrett, El Paso, Tex.

[73] Assignee: A.O. Smith Corporation, Milwaukee, Wis.

[21] Appl. No.: 47,662

[22] Filed: May 7, 1987

[51] Int. Cl.[4] ..... F24H 1/00

[52] U.S. Cl. ..... 126/362; 126/344; 122/380; 122/390; 137/563; 219/297

[58] Field of Search ..... 126/361, 344, 362, 350 R, 126/351; 122/235 J, 412, 444, 20 A, 20 B, 235 Q, 159, 380, 406 R, 390, 408 R, 397, 402, 407; 219/297, 310; 165/108, 109.1, 132; 137/268, 563, 565, 238

[56] References Cited

U.S. PATENT DOCUMENTS

| | | | |
|---|---|---|---|
| 759,380 | 5/1904 | Kane | 126/362 |
| 1,163,451 | 12/1915 | Polmann | 126/362 X |
| 3,499,423 | 3/1970 | Phlaum | 126/362 X |
| 3,762,395 | 10/1973 | Taylor | 126/350 R |
| 4,257,355 | 3/1981 | Cook | 122/390 X |
| 4,263,879 | 4/1981 | Lindahl | 122/159 |
| 4,385,723 | 5/1983 | Sanborn et al. | 126/351 X |
| 4,505,231 | 3/1985 | Syler | 122/17 X |
| 4,637,347 | 1/1987 | Troy | 122/20 A |

FOREIGN PATENT DOCUMENTS

| | | | |
|---|---|---|---|
| 23660 | 3/1981 | Japan | 126/362 |

*Primary Examiner*—Randall L. Green

*Attorney, Agent, or Firm*—Andrus, Sceales, Starke & Sawall

[57] ABSTRACT

An agitating mechanism to aid in preventing the buildup of sediment in a gas fired water heater. The agitating mechanism includes a pump located outside of the tank and a first conduit connects the inlet of the pump to the interior of the tank, while a second conduit connects the discharge side of the pump to the lower end of the tank. Operation of the pump will withdraw water from the tank and discharge the water back into the tank adjacent the lower head to help provide agitation and prevent the buildup of sediment. The conduits, as well as the pump, can be mounted on a cleanout panel which encloses a cleanout opening in the lower end of the tank.

6 Claims, 1 Drawing Sheet

SEDIMENT AGITATING APPARATUS FOR WATER HEATER

BACKGROUND OF THE INVENTION

In certain localities where water contains a high mineral content, sediment or lime can build up in a water heater tank. With a gas fired water heater, the gas burner is located generally in a compartment beneath the lower head, and the buildup of sediment on the lower head acts as an insulating layer to reduce the rate of heat transfer from the burner to the water in the tank. As the insulating layer increases in thickness, overheating of the lower head can result, which can, in some instances, result in rupture of the head.

To aid in preventing the buildup of sediment on the lower head of a gas fired water heater, agitator systems have been incorporated to agitate the water in the lower end of the tank. In a conventional water heater, as a faucet is opened in the water piping system, heated water will be drawn from the water heater and cold water will be introduced into the lower portion of the water heater tank. In the agitation systems as used in the past, the entry of the cold water has been employed to create the agitating action to prevent the buildup of sediment, as disclosed in U.S. Pat. Nos. 4,257,355 and 4,157,077.

SUMMARY OF THE INVENTION

The invention is directed to an improved agitation system for a water heater, which will help prevent the buildup of sediment or lime on the lower head of the tank. In accordance with the invention, a water circulation system is incorporated, separate from the makeup water inlet. The circulation system includes a pump located outside of the tank and a first conduit provides communication between the inlet side of the pump and the interior of the tank, while a second conduit connects the outlet side of the pump to the tank. Operation of the pump will draw water from the tank and discharge the water into the lower end of the tank adjacent the lower head to aid in preventing buildup of lime in that area.

In one form of the invention, the two conduits of the circulating system extend through separate openings in the tank wall, while in a second form of the invention the two conduits are in concentric relation and extend through a single opening in the tank wall.

It is contemplated that the circulation system can be incorporated with the panel that encloses the cleanout opening in the lower end of the tank or with the cold water inlet fitting. By incorporating the agitation system with the cleanout panel or the inlet fitting, the system can be readily retrofitted to existing water heaters without the necessity of drilling holes in the tank wall.

The pump can be operated continuously, or alternately, at various intervals through a timing mechanism, or in response to water draws from the tank.

With the construction of the invention, a more effective agitating action is achieved which will help prevent the buildup of sediment or lime in the lower end of the tank and thus maintain the desired rate of heat transfer from the burner to the water.

The agitation system also acts to prevent the stratification of heated water in the tank and thus prevents the water in the upper end of the tank from being overheated which can occur if short intermittent draws of water are required.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
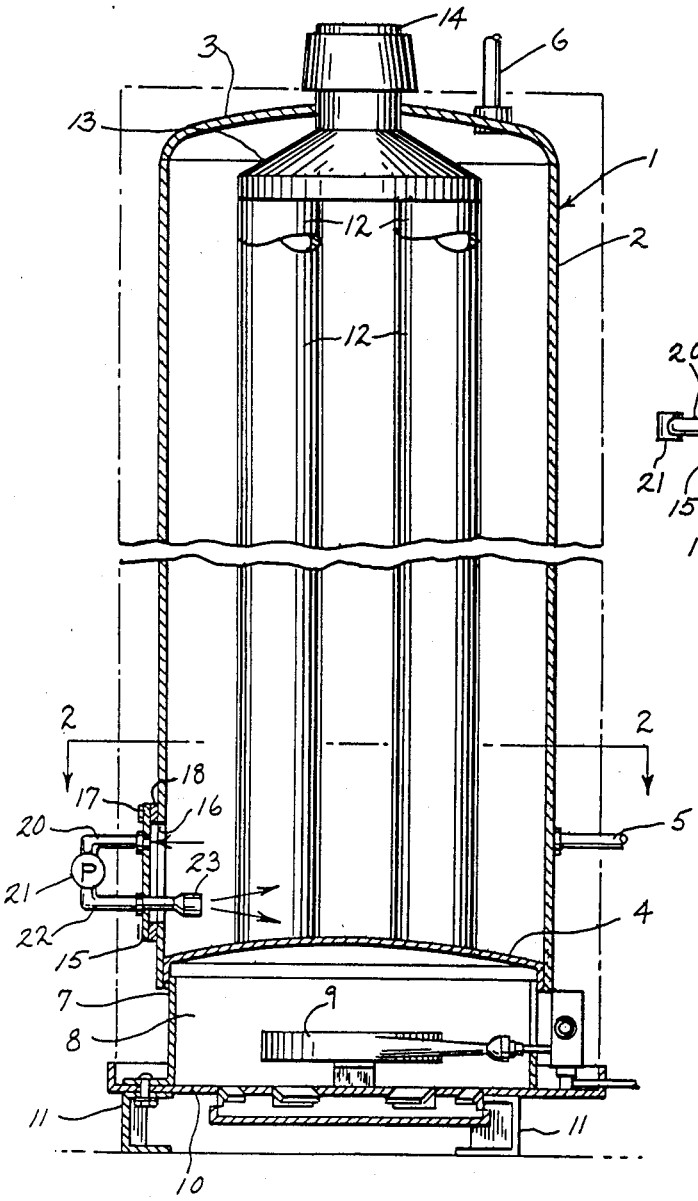
FIG. 1 is a is a vertical section of a water heater incorporating the agitation system of the invention.

FIG. 1 shows a commercial water heater including a tank 1 to contain water to be heated. Tank 1 is composed of a generally cylindrical shell 2 which is enclosed at its upper end by an upper head 3 and at its lower end by a lower head 4. Water is introduced into tank 1 through an inlet fitting 5 and is withdrawn from the upper end of the tank through an outlet 6.

Extending downwardly from the lower head is a cylindrical skirt 7 which defines a burner chamber 8. A gas-fired burner 9 is mounted within burner chamber 8 and serves to heat the water in tank 1.

The lower end of burner chamber 8 is closed by a plate 10 and a plurality of legs 11 extend downwardly from plate 10 and serve to support the water heater.

Tank 1 is enclosed by a layer of insulation, not shown. In some water heaters, the layer of insulation may take the form of a layer of foam plastic material, or alternately, a metal jacket may be mounted in spaced relation to tank 1 and a layer of insulation is located between the tank and the outer jacket.

The waste gas of combustion from operation of burner 8 are discharged through one or more of flues 12 which extend upwardly through tank 8. The upper ends of flues 12 are connected to a manifold 13 through which the gases are discharged to a stack 14 that communicates with the exterior.

Figure 2:
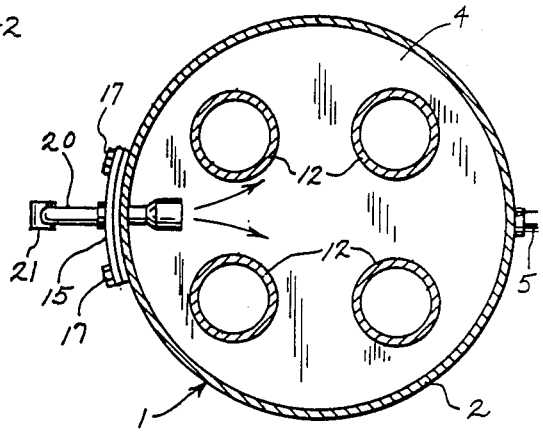
FIG. 2 is a section taken along line 2—2 of FIG. 2.

In accordance with the invention, a closed circulating system is employed to agitate the water in the lower end of tank 1. In the illustrated form of the invention, as shown in FIGS. 1 and 2, the circulation system is carried by a panel 15 which encloses a cleanout opening 16 in the lower end of tank 1. Panel 15 is connected to the tank by a plurality of bolts 17 and a gasket 18 seals the joint between the panel and the tank wall.

The circulating system is composed of a conduit or pipe 20 which is mounted within an opening in panel 15 and the outer end of the conduit 20 is connected to the inlet side of a pump 21. The discharge side of pump 21 is connected to one end of a second conduit 22 and the opposite end of conduit 22 is mounted within a second opening in panel 15. The inner end of conduit 22 extends into tank 1, so that the water will be discharged through the outlet end 23 in the form of a jet or high pressure stream. Outlet 23 is located adjacent the upper surface of lower head 4, so that the recirculating water will tend to agitate the water and sweep any sediment from the lower head.

Outlet 23 can take various configurations, such as a circular orifice, a fan-shaped aperture, or the like. In addition, the outlet 23 can be directed either horizontally or downwardly at an angle against the lower head 4.

Figure 3:
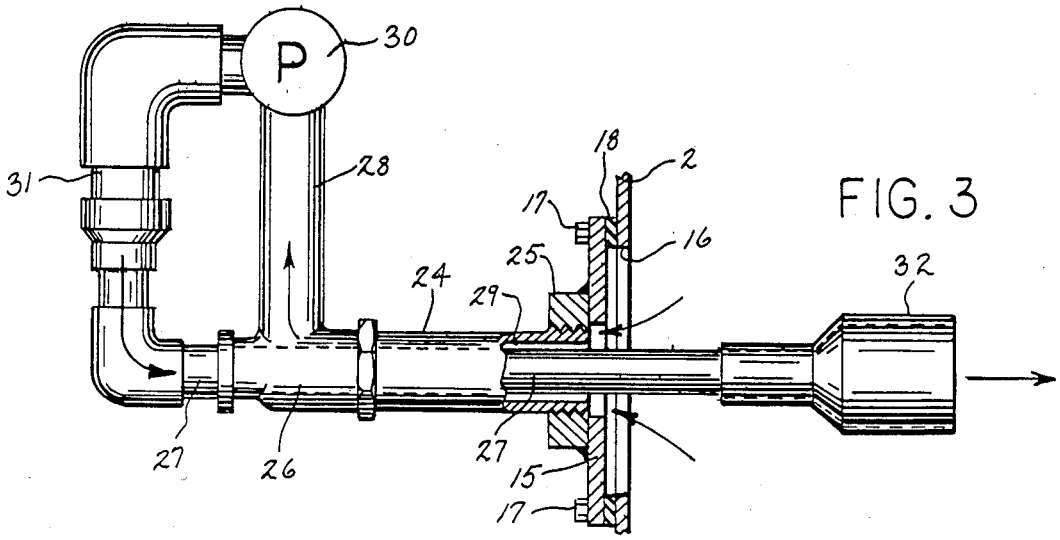
FIG. 3 is an enlarged fragmentary vertical section of a modified form of the invention.

FIG. 3 illustrates a modified form of the invention, in which the conduits of the circulating system are mounted in concentric relation so that both conduits are connected through a single opening.

In this embodiment, the circulating system includes an outer tube or conduit 24, which &s threaded within an opening in spud 25 that is secured to panel 15 and the outer end of the conduit is connected to a fitting 26. A second conduit 27 is mounted concentrically within conduit 24 and extends outwardly beyond fitting 26. Vertical pipe 28 is connected to fitting 26 and provides communication between the angular space 29 between conduits 24 and 27 and the inlet side of pump 30, while a conduit 31 is connected between the outer end of conduit 27 and the discharge size of pump 30. Mounted on the inner end of conduit 27 is a discharge nozzle 32.

Operation of pump 30 will draw water from the tank through the annular space 29 between conduits 24 and 27 and then through pipe 28 to the pump. Water will be discharged through conduit 31 and pipe 27 for return to the tank. As in the case of the first embodiment, the discharge of water into the lower end of the tank will agitate the water and prevent the buildup of sediment on the lower head.

The agitation system has a further advantage in that it will aid in preventing stratification of the water. As water is drawn from the tank, cold water will be admitted into the lower end of the tank and the entry of cold water into the lower end of the tank will normally trigger the thermostat to start the burner. Frequent intermittent operation of the burned can cause the water in the upper end of the tank to stratify and become overheated. The circulating system of the invention prevent stratification by acting to circulate the water within the tank and provide a substantially uniform water temperature throughout the tank volume.

Pump 21 can be operated continuously or intermittently. Intermittent operation can be controlled manually or automatically by a suitable timing device or through controls actuated by incoming or outgoing water.

While the drawings have shown the circulating mechanism mounted on the cleanout panel, it is contemplated that the circulating system can be mounted separately from the panel. However, the incorporation of the circulating system with the panel has the advantage that the agitation system can be retrofitted to existing tanks merely by replacing the original cleanout panel with a panel incorporating the agitation system. Further, it is contemplated that the circulating system can also be associated with the inlet water supply pipe. In this regard, water would be pumped from the tank and returned to the tank through a conduit disposed concentrically around the water inlet pipe.

Various modes of carrying out the invention are contemplated as being within the scope of the following claims particularly pointing out and distinctly claiming the subject matter which is regarded as the invention.

I claim:

1. A water heater, comprising a tank to contain water to be heated and having a lower head, inlet means for introducing cold water to said tank, outlet means disposed in the upper end of the tank for withdrawing heated water, heating means for heating the water in said tank, and agitating means for agitating the water in said tank, said agitating means comprising a closed circulation system including pumping means, first conduit means providing communication between the interior of the tank and the suction side of said pump means and second conduit means providing communication between the discharge side of said pumping means and the interior of said tank, said pumping means being constructed and arranged to withdraw water from said tank through said first conduit means and discharge through said second conduit means into the lower end of the tank and across said lower head to agitate the water and prevent buildup of sediment on the lower head of said tank, said tank having an access opening in the lower portion thereof, a removable panel to enclose said opening, said agitating means being carried by said panel.

2. The water heater of claim 1, wherein said first and second conduit means are mounted concentrically and communicate through a single opening with the interior of said tank.

3. The water heater of claim 1, wherein said second conduit means has one end connected to the discharge side of said pumping means and the opposite end is disposed with said tank and defines an outlet.

4. A water heater, comprising a tank to contain water to be heated and having a lower head, inlet means for introducing cold water to said tank, outlet means disposed in the upper end of the tank for withdrawing heated water, heating means disposed beneath said lower head for heating the water in said tank, the lower portion of said tank having a clean out opening, a panel removably secured to the outer surface of said tank and enclosing said opening, and agitating means separate from said inlet means for agitating the water in the tank and carried solely by said panel, said agitating means comprising a closed circulation system including a pump, first conduit means providing communication between the interior of the tank and the suction side of the pump and second conduit means providing communication between the discharge side of the pump and the interior of the tank, said second conduit means being provided with an outlet disposed adjacent said lower head, operation of said pump acting to withdraw water from said tank through said first conduit means and discharge the water into the lower end of the tank through said second conduit means to agitate the water and prevent buildup of sediment on said lower head.

5. The water heater of claim 4, wherein said heating means comprises a gas fired burner located beneath the lower head, and said through said tank for discharging waste gases of combustion generated by said burner.

6. The water heater of claim 4, wherein the axis of said outlet is generally horizontal and is disposed to direct the water across said lower head.

* * * * *

UNITED STATES PATENT AND TRADEMARK OFFICE

CERTIFICATE OF CORRECTION

PATENT NO. : 4,790,291

DATED : December 13, 1988

INVENTOR(S) : Fred E. Barrett

It is certified that error appears in the above-identified patent and that said Letters Patent is hereby corrected as shown below:

IN THE CLAIMS: Col. 4, line 30, delete "with" and substitute therefor ---within---; Col. 4, line 56, after "said" (1st occurr.) insert ---water heater including flue means extending upwardly---

Signed and Sealed this

Twenty-sixth Day of December, 1989

*Attest:*

JEFFREY M. SAMUELS

*Attesting Officer* *Acting Commissioner of Patents and Trademarks*